US009163907B2

(12) United States Patent
Schwarz

(10) Patent No.: US 9,163,907 B2
(45) Date of Patent: Oct. 20, 2015

(54) ADAPTIVE CAMOUFLAGE

(75) Inventor: René Schwarz, Watt (CH)

(73) Assignee: SSZ CAMOUFLAGE TECHNOLOGY AG, Zug (CH)

( * ) Notice: Subject to any disclaimer, the term of this patent is extended or adjusted under 35 U.S.C. 154(b) by 402 days.

(21) Appl. No.: 13/380,672

(22) PCT Filed: Jun. 10, 2010

(86) PCT No.: PCT/EP2010/058169

§ 371 (c)(1),
(2), (4) Date: Dec. 23, 2011

(87) PCT Pub. No.: WO2011/000679

PCT Pub. Date: Jan. 6, 2011

(65) Prior Publication Data

US 2012/0091111 A1 Apr. 19, 2012

(30) Foreign Application Priority Data

Jun. 30, 2009 (CH) ..... 1013/09

(51) Int. Cl.
*H05B 1/00* (2006.01)
*F41H 3/02* (2006.01)

(52) U.S. Cl.
CPC ..... *F41H 3/02* (2013.01)

(58) Field of Classification Search
CPC .. B63G 13/00; B63G 13/02; B63G 2013/025; F41H 3/00
USPC ..... 219/520, 521, 522, 538–553
See application file for complete search history.

(56) References Cited

U.S. PATENT DOCUMENTS

| | | | | |
|---|---|---|---|---|
| 4,609,034 | A | 9/1986 | Kosson et al. | |
| 5,080,165 | A * | 1/1992 | Engelhardt | 165/46 |
| 5,751,006 | A * | 5/1998 | Cooper | 250/495.1 |
| 6,128,999 | A | 10/2000 | Sepp et al. | |
| 6,753,075 | B1 * | 6/2004 | Leupolz et al. | 428/323 |
| 2009/0104419 | A1 * | 4/2009 | Dumas | 428/215 |

FOREIGN PATENT DOCUMENTS

| | | | |
|---|---|---|---|
| DE | 38 04 991 | C1 | 7/1999 |
| DE | 10 2005 01884 | A1 | 10/2006 |
| DE | 102005018844 | A1 * | 10/2006 |
| EP | 0 163 557 | A2 | 12/1985 |
| EP | 1 574 809 | A1 | 9/2005 |

OTHER PUBLICATIONS

International Search Report and Written Opinion dated Sep. 7, 2010. International Application No. PCT/EP2010/058169; International Filing Date: Jun. 10, 2010.

International Preliminary Report and Written Opinion mailed Jan. 12, 2012 and Translation of International Preliminary Report and Written Opinion mailed Jan. 26, 2012. International Application No. PCT/EP2010/058169; International Filing Date: Jun. 10, 2010.

* cited by examiner

*Primary Examiner* — Dana Ross
*Assistant Examiner* — Brandon Harvey
(74) *Attorney, Agent, or Firm* — Oliff PLC

(57) ABSTRACT

In a system for the adaptive camouflage of objects, particularly of vehicles, at least one panel-like layer (5) is provided, which is at least partially air-permeable. The air suctioned in from the surroundings can be controlled, before or while it is fed into the layer, to a temperature that is determined at least almost from the background of the object.

10 Claims, 2 Drawing Sheets

ADAPTIVE CAMOUFLAGE

RELATED APPLICATION

This application is a U.S. national phase application under 35 U.S.C. §371 of International Application No. PCT/EP2010/058169 filed Jun. 10, 2010, claiming priority under 35 U.S.C. §119 of Switzerland application no. 1013/09 filed Jun. 20, 2009.

TECHNICAL FIELD

The present invention relates an arrangement for adaptively camouflaging objects, such as in particular mobile vehicle-bound objects, and to a method for adaptive camouflage.

BACKGROUND AND SUMMARY

Multispectral camouflage for modern warfare must keep pace with the technical development of sensors while accommodating the demand for high mobility.

For one, today's armies have high requirements when it comes to mobility. In addition, the technical possibilities of multispectral reconnaissance and target assignment have widened to a considerable degree with the miniaturization of sensors and the emergence of new platforms such as the cost-effective minidrones. This technology must also keep pace with modern means and use ultra-modern technologies if camouflage is to remain a serious means and fulfil its objective. Of particular interest in this context is today camouflage against all-weather radar sensors or thermal infrared sensors, which enable reconnaissance even at night.

Today, fully developed mobile camouflage kits, which are produced to fit perfectly onto the vehicle surface, are offered commercially. These camouflage kits from various textile materials are effective in visual camouflage by way of an appropriate color scheme and in RADAR by way of scattering or absorbing materials. In thermal infrared, an effect is also achieved by the textile upper material being provided with a sheet cut which assumes the air temperature in the airflow during travel. The upper material is sewn onto an insulation layer or other textile material, which insulates the surface temperature of the vehicle from the upper material. In addition to the convective effect for matching the signature to the environment, the textile upper material can additionally have the property of reduced thermal emissivity, which ensures that portions of the cold sky are reflected. The system thus described already has a decent effect, especially as compared to non-camouflaged vehicles. With respect to the technological development on the sensor side, however, it is desirable for the signature of the vehicle to follow the background as accurately as possible. The signature must here not always necessarily follow the air temperature. It is possible, in particular in deserts or other environments with little vegetation, to observe relatively great deviations of the ground temperature from the air temperature, to be precise in both directions.

Another solution is outlined in EP 1 574 809, where a metal foam is used as a heat exchanger and where air serves as a heat-transfer medium.

It is the object of the present invention to provide multispectral camouflage, which not only takes into account the improved sensor systems but also meets the requirements for high mobility.

According to the invention, a camouflage arrangement for adaptively camouflaging objects is proposed.

The proposal relates to at least one panel-like layer being used in the arrangement, through which panel-like layer air can flow, wherein the air which is taken in from the environment is regulatable, before or during the supply into the layer, to a temperature which has at least already been ascertained from the background of the object.

The solution developed in the present invention is based on adaptive, thermal camouflage for mobile, vehicle-bound platforms, possibly in combination with flexible radar absorbers. At its core, infrared sensors are used to continuously measure for example the entire environment) (360°) of the object, or the vehicle/platform, to be camouflaged and to segment in real time the information obtained and use it as a transmitter signal. Used as the adaptive camouflage material are various panels, such as in particular the abovementioned panel-like layer through which air can flow, which panels are individually brought dynamically to the corresponding temperature according to the background signal.

Each panel can in this case be connected to a radar absorber and be fabricated to fit perfectly to the object form or the vehicle form. The infrared signature generated is in this case independent from the object surface temperature and the environment air temperature and dynamically follows the background temperature.

To achieve optimum camouflage effect, the background is here measured using a radiometrically calibrated IR camera and the image is segmented or average values continuously calculated from individual image portions. These temperatures serve as measured value indicators for active camouflage.

The physical realization is based on cushions through which air flows, such as the panel-like layer through which air can flow, as mentioned in the introduction. Cold air is in this case taken in and electrically heated in the through-flow while it is being supplied to the respective air cushions. Each air cushion is regulated individually. A thermometer in the air cushions measures the respective temperature, which is then compared to the measured value indicator for this cushion and serves as feedback for controlling the heating.

The air can of course be supplied in a cooled state, either by using a dedicated air-conditioning system for the air cushions or, in the case of camouflage for a vehicle, by using a cold-air passage of the vehicle's air-conditioning system.

The construction of the camouflage arrangement was realized here as follows: on the vehicle-side, first tarpaulin material is wrapped around an insulating mat of, for example, cm thickness. This serves for isolating the active side from the surface temperature of the vehicle (e.g. engine space etc.). The layer, into which air is blown, is arranged on this insulating mat. Said air is allowed to escape upwards through a thin textile material, which is permeable to air. Said air-permeable material then outwardly exhibits the new signature in a thermal image. In order that the airflow during travel cannot influence the surface temperature of this material, the air cushion receives a third layer: separated by an air gap of about 2 cm from the air-permeable material, a for example thin polyethylene film is applied, which is so thin that it is transparent in IR and thus does not have its own signature. Heating by the sun or the action of the airflow during travel should not influence the signature of the cushion. The air escapes from the panel through air slits in the film.

In order to achieve radar camouflage in addition to the IR camouflage, the insulating mat can be interchanged or supplemented by a radar absorber.

Particular attention must be paid to the optimal air-guidance inside the panel: the inflowing air must spread out homogeneously as quickly as possible. This is achieved by air distributers made of flexible plastic hoses which have lateral openings for distributing the air quickly in the entire panel.

As shown above, the solution described here differs from today's commercially available mobile camouflage kits in that it actively matches the environment.

The proposed solution is distinguished from the solution described in EP 1 574 809 in that attention was paid to homogeneous and quick air distribution. Thereupon, the various camouflage areas (infrared and radar) are materially separate in the proposed solution according to the invention. An important aspect is that through use of an IR-transparent film the influence of the airflow during travel or the temperature of the airflow during travel is negated and it is thus possible to effectively achieve that the apparent temperature or signature of the panels can be matched to the measured apparent ambient temperature.

BRIEF DESCRIPTION OF DRAWINGS

The invention will now be explained in more detail by way of example with reference to the appended figures, in which.

DETAILED DESCRIPTION

Figure 1:
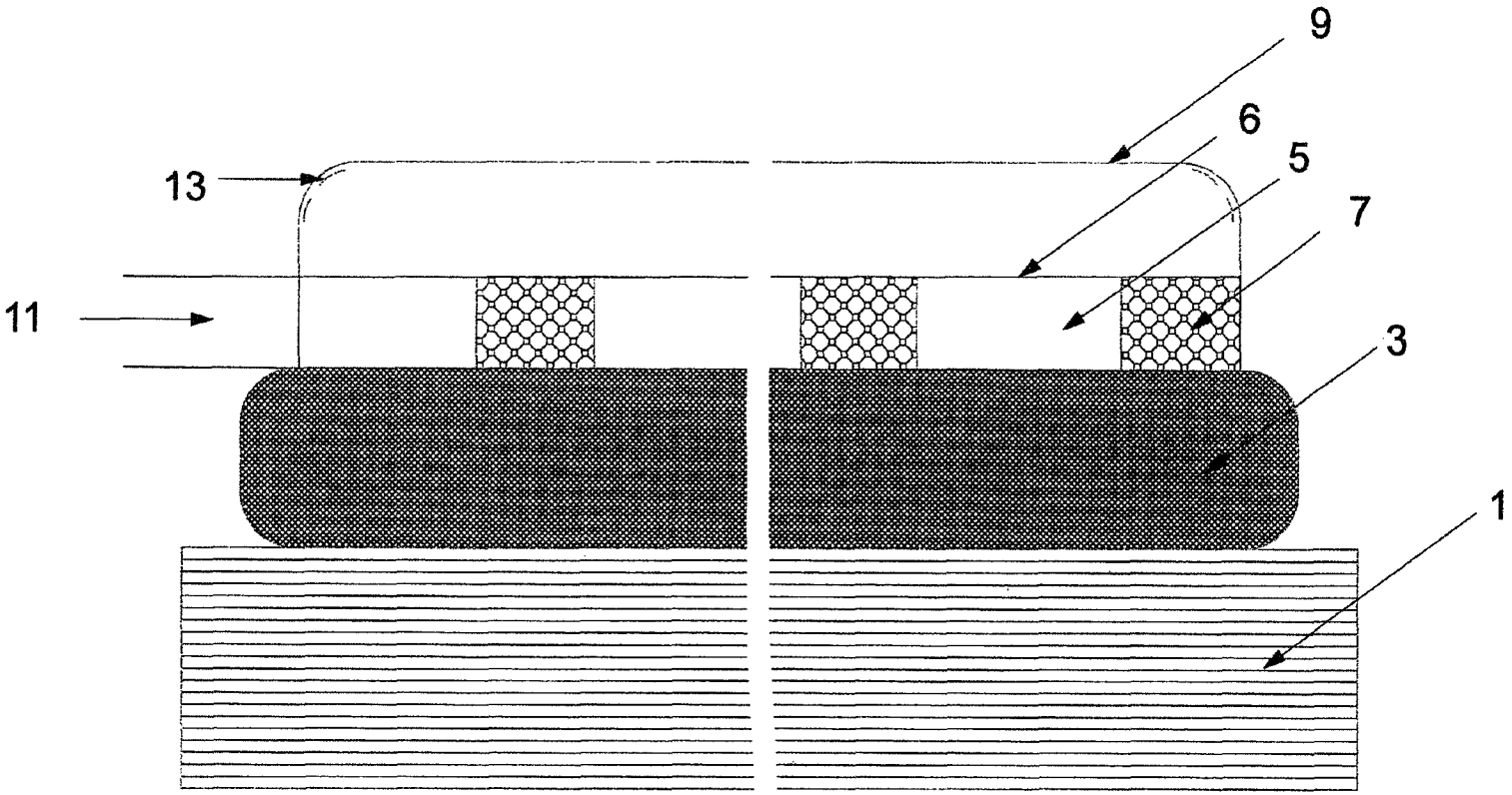
FIG. 1 schematically shows the construction of an adaptive camouflage arrangement according to the invention in section and FIG. 2 schematically shows the panel-like layer, through which air can flow, of the arrangement from FIG. 1 in plan view.
Figure 2:
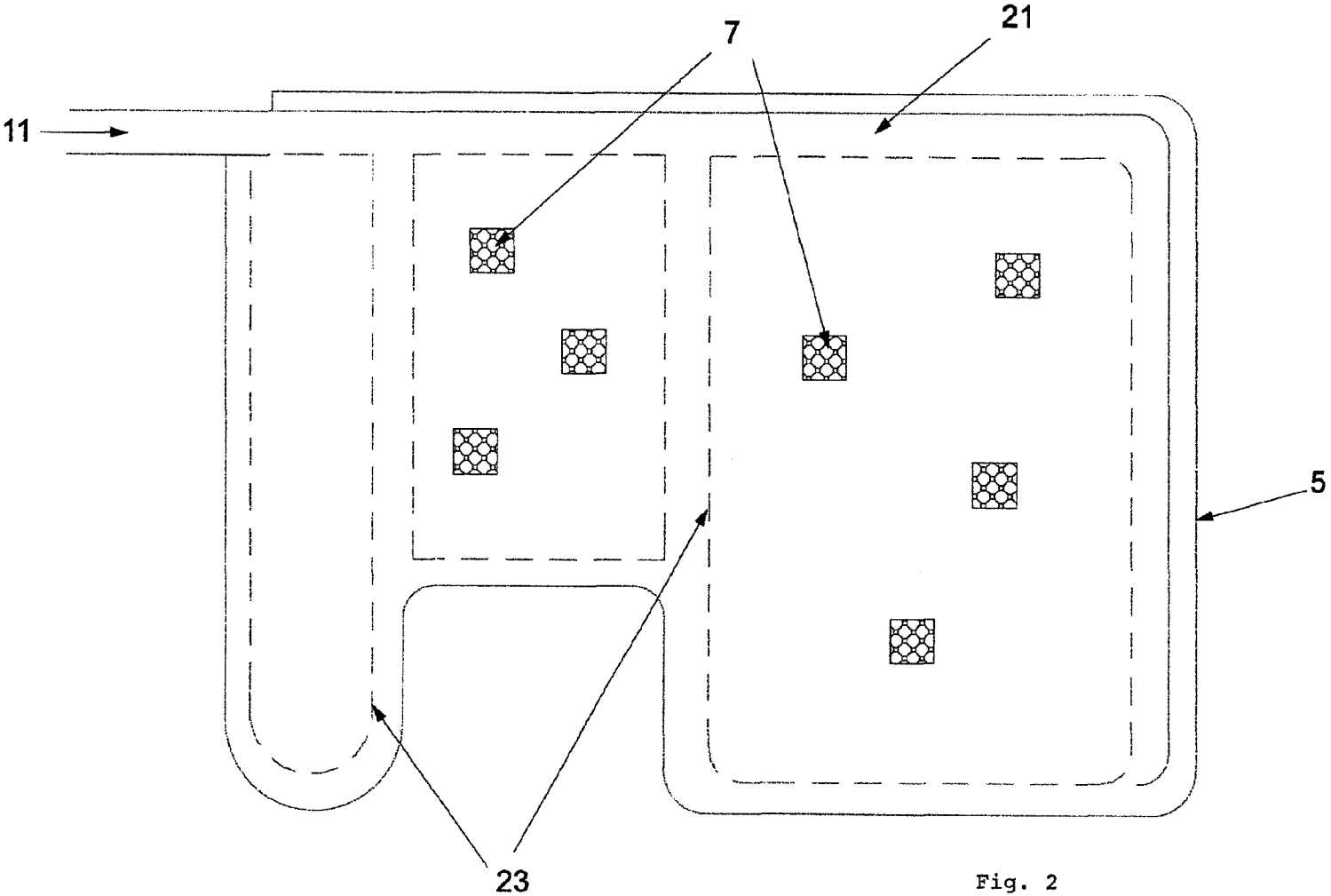

FIG. 1 schematically shows a section through an adaptive camouflage arrangement according to the invention, which is arranged on an object 1 in order to camouflage the latter. Object 1 is for example a mobile object such as a vehicle. First, an insulating mat 3 is arranged on the object such that it bears directly against it, with for example a tarpaulin material such as a PVC-coated polyester woven fabric being wrapped around said insulating mat 3. The weight is typically 500 to 700 gram per $m^2$. Arranged on the insulating mat, which is for example 2 cm thick, is the panel-like layer 5, through which air can flow and which has spacers 7 to create the air cushion, which spacers can consist for example of 3D knitted fabrics. An air supply 11 is provided laterally. The air, which is taken in from the outside and is heated using a heating unit (not shown) is blown into the air cushions. With reference to FIG. 2, the layer 5, through which air can flow, will be explained in detail below. In order that the air can escape from this layer, it is covered by a thin textile material 6, which is permeable to air. This air-permeable woven material preferably has a high strength and can be produced for example from an aromatic polyamide fiber such as an aramid. Nomex and Kevlar from DuPont, for example, are known aramid fibers.

This air-permeable material then outwardly exhibits the new signature in a thermal image. To prevent for example the airflow during travel from influencing the surface temperature of this material, the arrangement contains a third layer. Separated by an air gap 8 of about 2 cm from the air-permeable material, a thin infrared-transparent film 9 is arranged, wherein the film 9 may be for example a thin polyethylene film. Said film is thin so that it is transparent in infrared and thus does not exhibit its own signature. It is preferably UV-stabilized and has a thickness of the order of magnitude of 50 to 100 micron.

The air from the arrangement can escape laterally from the infrared-transparent film through slits 13.

Special attention is paid to the optimum air-guidance inside the panel-like layer 5, through which air can flow.

FIG. 2 shows how the temperature-regulated air, which is blown in from the outside via the air supply 11, is distributed in the layer 5. This takes place, for example, by means of flexible tubes 21 having lateral openings 23. In this way the air from the flexible plastic hoses can distribute quickly in the entire panel. FIG. 2 also shows the spacers 7.

The arrangement shown in FIGS. 1 and 2 is of course only an example which serves to better explain the present invention. It is of course possible to configure or modify the camouflage arrangement in a manner which deviates from that shown in FIGS. 1 and 2 or to supplement it by further layers. For example, it is possible to interchange the insulating mat for a radar absorber or to supplement the former by the latter. A wide variety of solutions are possible also with respect to the heating of the air. By way of example, the cool air at the entry to the panel can be heated by an electric heating coil. The air temperature inside the panel is controlled by controlling the electric output of the coil similar to a hair dryer.

The supply of air can of course also take place in a cooled state, either by using a dedicated air-conditioning system in the arrangement for the air cushions or, in case a vehicle is to be camouflaged, by using the cold-air passage of the vehicle's air-conditioning system.

The construction of the insulating mat can also vary and, in the case of a radar absorber, a foam can be used, filled or impregnated with graphite particles.

The invention claimed is:

1. An arrangement for adaptively camouflaging an object in an environment against a background of the object, the arrangement comprising at least one air cushion, each air cushion containing a panel layer, through which air taken in from the environment can flow at least partially, wherein the air which is taken in from the environment is regulatable, before or during the supply into the panel layer, to a temperature which has at least already been ascertained from the background of the object, the panel layer is defined between an insulating mat and an air-permeable layer by arranging a number of spacers between them to allow for proper distribution of the air inside the panel layer, wherein the insulating mat is arranged on the object and the air-permeable layer is made permeable to air, and wherein the temperature of each of the air cushions is individually regulatable by blowing in temperature-regulated air into each air cushion via an air-supply, individually, and wherein the panel layer, through which air can flow, is covered by a further layer, which is IR-transparent.

2. The arrangement of claim 1, further comprising a sensor system which includes at least one infrared sensor for measuring the temperature of the background of the object.

3. The arrangement of claim 1, wherein the arrangement has multiple layers, and wherein the air-cushion-containing layer is arranged on an insulating mat in order to isolate the panel layer with respect to the object from the surface temperature thereof.

4. The arrangement of claim 1, wherein the panel layer, through which air can flow, is covered by the air-permeable layer with respect to the outside.

5. The arrangement of claim 1, wherein the further layer is a thin polyethylene film, which is UV-stabilized and has a thickness of about 50 to 100 micron.

6. The arrangement of claim 1, wherein the air-cushioning-containing layer is arranged on a radar-absorbing layer.

7. The arrangement of claim 1, wherein the air-cushion-containing layer is arranged on the insulating mat in order to isolate the panel layer with respect to the object from the surface temperature thereof, and wherein tarpaulin material, including a PVC-coated polyester woven material, is wrapped around the insulating mat.

8. The arrangement of claim 1, wherein the air is electrically heatable and distributable as homogeneously as possible in the panel layer, through which air can flow, using flexible hoses, which have openings, in the panel layer.

9. A method for adaptively camouflaging an object in an environment against a background of the object, the method comprising:

covering an object using an arrangement comprising at least one air cushion, wherein air flows through at least one panel layer provided by the cushions through which air can flow, the panel layer is defined between an insulating mat and an air-permeable layer by arranging a number of spacers between them to allow for proper distribution of the air inside the panel layer, wherein the insulating mat is arranged on the object and the air-permeable layer is made permeable to air, and wherein the panel layer, through which air can flow, is covered by a further layer, which is IR-transparent, flowing air from the environment into the panel layer provided by the cushions, wherein the air that is taken in from the environment is regulated before or while it is flowing into the panel layer provided by the cushions to a temperature which has at least already been ascertained from a temperature of the background of the object by blowing in temperature-regulated air via an air-supply.

10. The method of claim 9, wherein the temperature-regulated air flows into the panel layer provided by the cushions as homogeneously as possible using flexible hoses having openings, which air leaves the panel layer via the air-permeable layer that covers the panel layer to the outside in order to arrive in the further, IR-transparent layer which covers the panel layer provided by the cushions, which IR-transparent layer has air-outlet openings at its edge.

* * * * *